US006287226B1

(12) United States Patent
Dilling

(10) Patent No.: US 6,287,226 B1
(45) Date of Patent: Sep. 11, 2001

(54) GAME BALL AND GOAL

(76) Inventor: Jan B. Dilling, #10 Fifty First Ave., Isle of Palms, SC (US) 29451

( * ) Notice: Subject to any disclaimer, the term of this patent is extended or adjusted under 35 U.S.C. 154(b) by 0 days.

(21) Appl. No.: 09/241,256

(22) Filed: Feb. 1, 1999

Related U.S. Application Data

(60) Provisional application No. 60/073,751, filed on Feb. 2, 1998.

(51) Int. Cl.[7] ..... A63B 37/02

(52) U.S. Cl. ..... 473/594; 473/598

(58) Field of Search ..... 473/594, 596, 473/598, 603, 604, 606, 612; D21/707, 713

(56) References Cited

U.S. PATENT DOCUMENTS

| | | | | |
|---|---|---|---|---|
| D. 393,030 | * | 3/1998 | Mills | D21/713 |
| D. 422,040 | * | 3/2000 | Stalberger, Jr. | D21/713 |
| 2,301,506 | | 11/1942 | Bean . | |
| 3,679,212 | | 7/1972 | Smith . | |
| 3,794,318 | | 2/1974 | Holmes . | |
| 3,937,470 | | 2/1976 | Stalberger, Jr. . | |
| 4,151,994 | | 5/1979 | Stalberger, Jr. . | |
| 4,354,679 | | 10/1982 | Steinmetz . | |
| 4,717,158 | | 1/1988 | Pennisi . | |
| 5,123,659 | | 6/1992 | Williams . | |
| 5,294,112 | | 3/1994 | Smith . | |
| 5,332,230 | | 7/1994 | Benedict . | |
| 5,429,351 | | 7/1995 | Hanson . | |
| 5,433,434 | | 7/1995 | Helmetsie . | |
| 5,566,953 | | 10/1996 | Arriola et al. . | |
| 5,813,932 | * | 9/1998 | Grafton | 473/594 |

FOREIGN PATENT DOCUMENTS

| | | | | |
|---|---|---|---|---|
| 682750 | * | 10/1939 | (DE) | 473/148 |

* cited by examiner

*Primary Examiner*—Steven Wong

(57) ABSTRACT

The present invention includes: a substantially spherical, impact deformable, shape retaining, textured game ball, comprising: a) pliable leather or leather-like textured ball cover, the cover comprising identical, connected cover members having a discreet symmetrical S-shape; b) a collapsible, regularly apertured shape retainer enclosed by and adjacent to the cover, and c) an inner space comprising a plurality of like-sized flexible bladders within the game ball, each bladder comprising a volume of air and a quantity of pellets. Also included is a game goal, comprising: a) a frame in the general shape of a flat cylinder with a vertical axis and a diameter greater than its depth; the frame comprising two like, horizontal circles, one on top and one on the bottom of the goal, and three or more rigid vertical members extending upward and connect the bottom frame circle to the top frame circle; and b) netting suspended inside the frame from the top in a generally conical shape, and stretched from one vertical member to another across the inside diameter of the cylindrical frame to form three vertical side goal planes and a top facial plane; wherein a goal is scored when a game player strikes a game ball into any of the goal planes.

1 Claim, 5 Drawing Sheets

FIG. 1
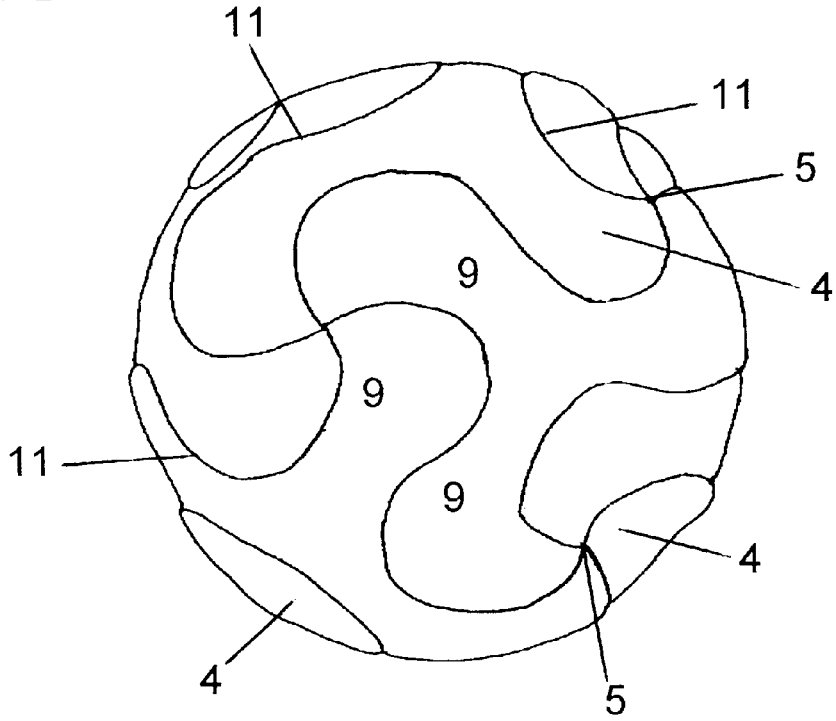
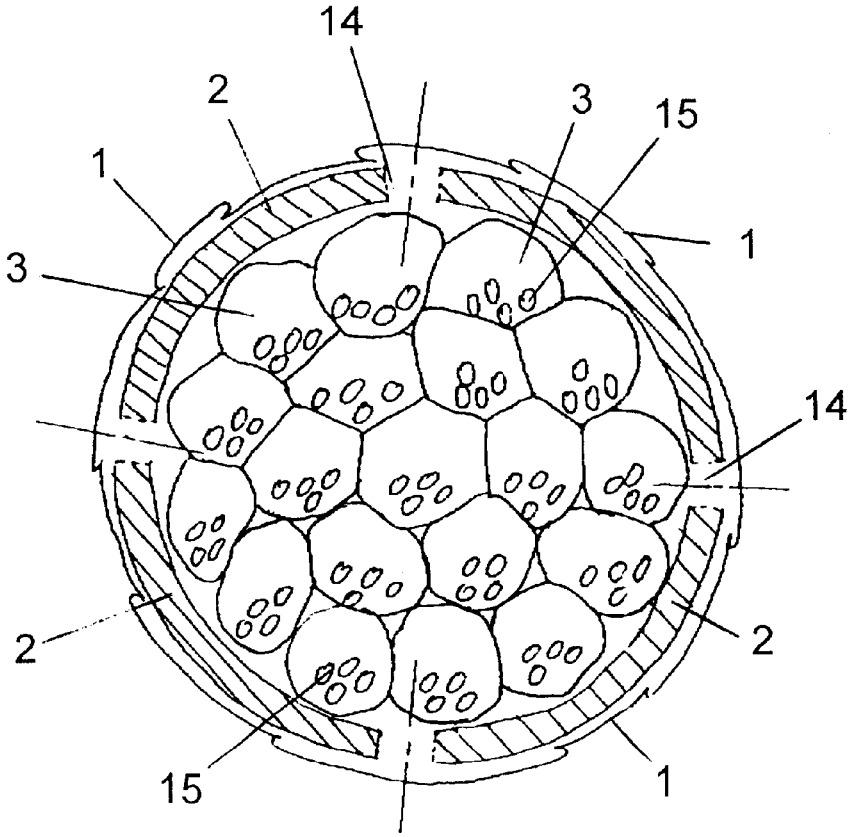
FIG. 2

GAME BALL AND GOAL

CROSS REFERENCE TO RELATED APPLICATIONS

I claim the benefit of U.S. provisional patent application Ser. No. 60/073,751, filed Feb. 2, 1998.

BACKGROUND OF THE INVENTION

1. Technical Field

The present invention relates generally to a game ball and goal, more particularly to an air pellet suspension game ball for a new open field sport and a game goal comprising a wedge-shaped or cylindrical frame and net. The invention further includes a parallelogram-shaped field of play comprised of two adjacent, mirror image, triangular field halves with one goal located in the center of each respective triangular half of the field.

2. Background Information

Open-field team sports such as soccer, football, rugby, field hockey, lacrosse, handball, and basketball are played on a field or court having opposing goals, the object being, generally, to advance a game ball or object across the opposing teams goal. Such sports provide a diverse and entertaining exercise of physical coordination and teamwork.

Shortcomings of existing sports of the type described include aggressive physical contact, large teams, and large playing fields, or alternately, as in basketball, dramatic height advantages, limiting their enjoyment and accessibility. Additionally, since the vast majority of such sports are played predominantly with the hands, thereby challenging a player's hand-to-eye coordination, a significant need exists for an open-field team sport played predominantly with the feet, thereby challenging a player's foot-to-eye coordination.

Although soccer is played predominantly with the feet, its shortcomings, in addition to those common to open-field team sports, also include low scoring and frequent ties. Other existing sports, such as footbag sports, which challenge a player's foot-to-eye coordination, are generally played in a stationary position or alternately over a 5 foot net, thereby precluding open-field team sports as defined. The new open-field team sport called socci is played predominantly with the feet, and requiring fewer players and less space. It is an evolved, non-contact method of play which does not disproportionately favor tall players.

The present invention provides a highly textured impact deformable, shape retaining, air/pellet composite game ball, which may be controlled by repeated airborne kicking or the like, by a stationary player or a player in motion, and which may also be played reliably from a significant first bounce, or alternately from the ground. The present invention is also a portable, multifaceted, prism-shaped goal which may be scored upon via three vertical rectangular side goal planes or one horizontal triangular top goal plane, which goal planes are internally segregated by netting. The present invention further includes a diamond-shaped field of play composed of triangular field halves such that the goals may be concentrically located within their respective triangular sides of the field.

BRIEF SUMMARY OF THE INVENTION:

The present invention includes: a substantially spherical, impact deformable, shape retaining, textured game ball, comprising:

a) pliable leather or leather-like textured ball cover, the cover comprising identical, connected cover members having a discreet symmetrical S- shape;

b) a collapsible, regularly apertured shape retainer enclosed by and adjacent to the cover, and c) an inner space comprising a plurality of like-sized flexible bladders within the game ball, each bladder comprising a volume of air and a quantity of pellets.

Also included is a game goal, comprising:

a) a frame in the general shape of a flat cylinder with a vertical axis and a diameter greater than its depth; the frame comprising two like, horizontal circles, one on top and one on the bottom of the goal, and three or more rigid vertical members extending upward and connect the bottom frame circle to the top flame circle; and b) netting suspended inside the frame from the top in a generally conical shape, and stretched from one vertical member to another across the inside diameter of the cylindrical frame to form three vertical side goal planes and a top facial plane;

wherein a goal is scored when a game player strikes a game ball into any of the goal planes.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIG. 1 shows a perspective view of a game ball according to the present invention;

FIG. 2 is a cross sectional view through the center of a game ball according to the present invention;

DETAILED DESCRIPTION OF THE INVENTION

Figure 3:
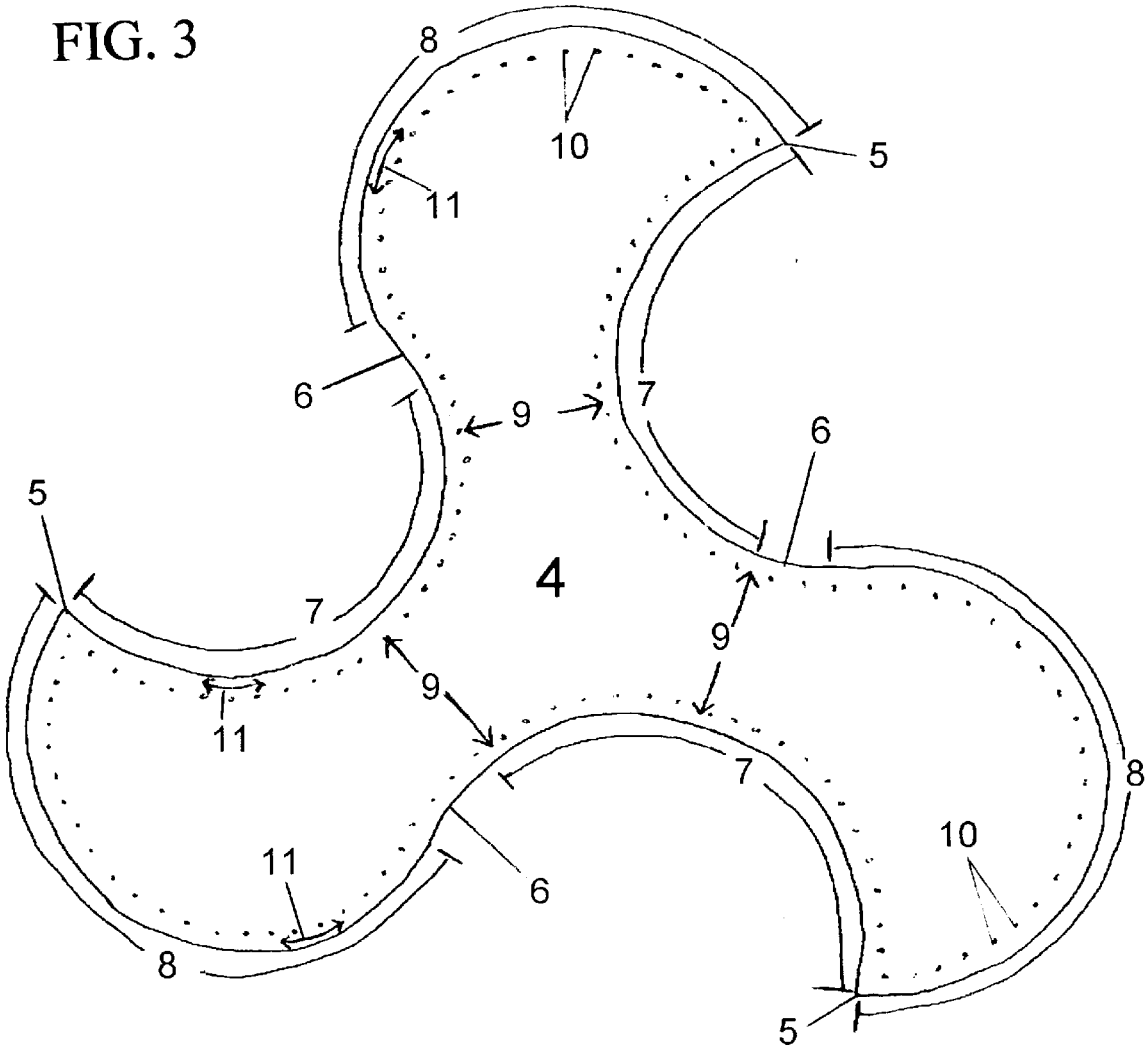
FIG. 3 is a front view of a cover member of a game ball according to FIG. 1.

In the following description, like reference characters designate like or corresponding parts throughout the several views. Also, in the following description, it is to be understood that such terms as "front", "back", "within," and the like are words of convenience and are not to be construed as limiting terms. Referring in more detail to the drawings, the invention will now be described.

Socci Ball

Cover

With continued attention to FIGS. 1 and 2, the preferred embodiment of the Socci game ball includes a highly textured, pliable leather or leather-like cover 1, a collapsible, regularly apertured shape retainer 2, and a plurality of like-sized flexible bladders 3 each containing a volume of air and a quantity of pellets 15.

The preferred embodiment of the game ball is 4¼ inches in diameter and weighs 4½ ounces. The combined effect of the cover 1, retainer 2, bladders 3, and pellets 15 is a substantially spherical, impact deformable, shape retaining, highly textured ball having the combined characteristics of an air-filled ball and a pellet-filled ball. The preferred embodiment has a rebound propensity of approximately 4 inches when dropped from 5 feet.

Game ball cover 1 is composed of identical cover members 2 having a discreet symmetrical S-shape. The cover member 4 generally spiral about a central area as shown in FIG. 3 for reference, and are defined by connecting equilateral points 5 using alternately curving S-shaped edges 6. The edges 6 include inner-curve sections 7, outer-curve sections 8, and further define centrally located minor-width sections 9.

The peripheries of cover members 4 are perforated by a plurality of seam holes 10 for the purpose of assembly by hand stitching. Seam holes 10 of the preferred embodiment are spaced approximately 3⁄16 of an inch from the edges 6 and approximately 3⁄16 of an inch from each other, thereby defining S-shaped marginal areas 11 roughly 1½ times longer than conventional construction using straight or slightly bowed edges connecting the same equilateral points 5.

Cover members 4 are adjoined in a manner common to footbag construction wherein members are sewn along adjacent abutting marginal areas 11, such as to form a collapsible chamber of sufficient spherical dimensions when fully expanded. Also common to footbag construction, cover members 4 are sewn inside out, in an octahedral configuration, reversed, and filled as described infra, prior to closing. Additionally common to footbag construction by hand stitching, is a gathering of marginal areas 11 imparted by tensioning of stitching.

Figure 4:
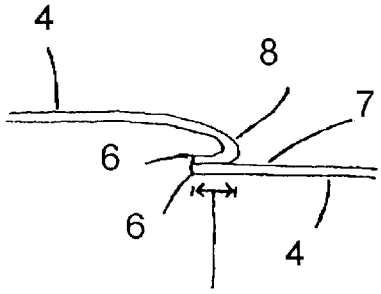
FIG. 4 is a side view of two adjoining cover members of the game ball of FIG. 1.
Figure 5:
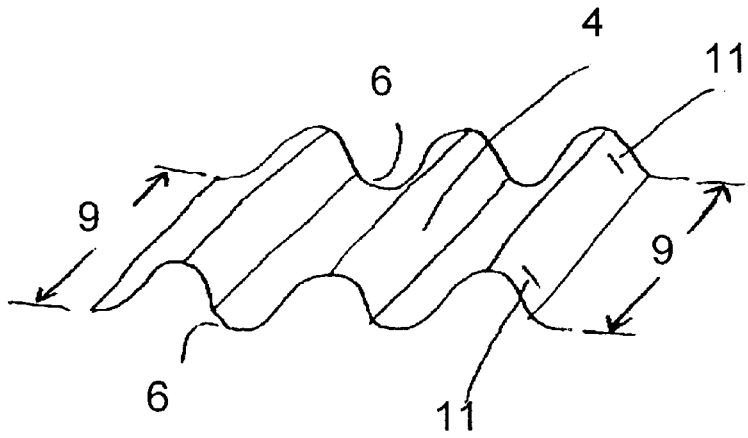
FIG. 5 is a perspective view of a minor width section from the game ball of FIG. 3, showing waving.

The present invention utilizes a pronounced gathering, which imparts increased rigidity to adjoined marginal areas 11 when compared to slight gathering of conventional construction. Furthermore, such tensioning along S-shaped marginal areas 11 causes a distinct folding along outer-curve sections 8 as illustrated by FIG. 4, and a distinct waving along minor-width sections 9, caused by folding of opposite cover members 4 along their outer-curve sections 8, such that the pronounced waves of gathering of marginal areas 11 align as shown in FIG. 5.

Figure 6:
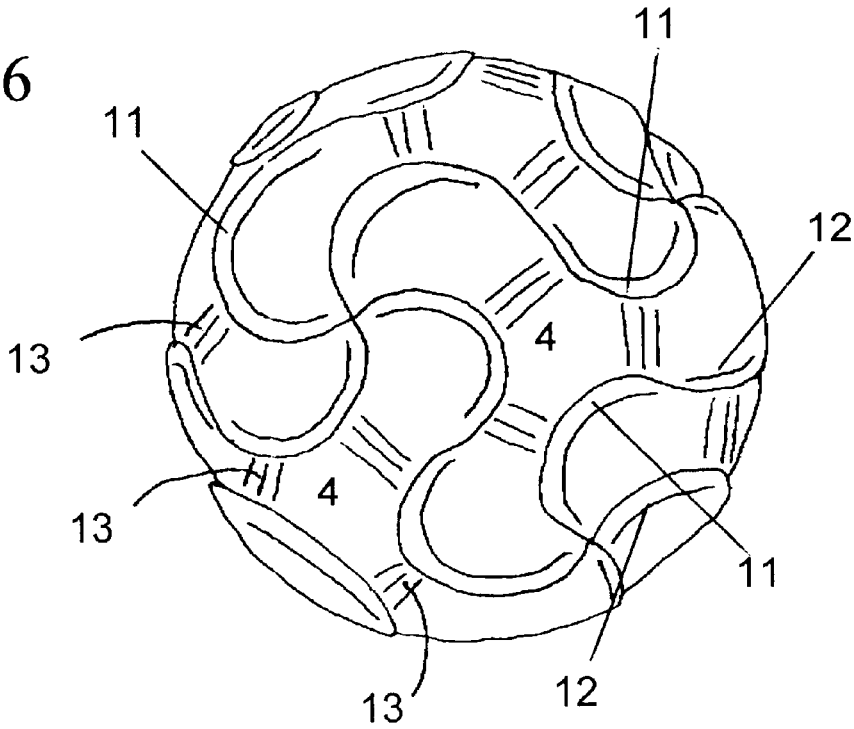
FIG. 6 shows a perspective view of a game ball according to the present invention, showing texture.

With attention to FIG. 6, the combined effect of folding 12 and waving 13 imparted by elongated s-shaped marginal areas 11 gathered by increased tensioning of stitching and having increased rigidity, defines a regular pattern of texturing, contributing increased traction and grip when kicked, thus improving the ball's overall performance.

Regarding alternate cover embodiments, it should be appreciated that such construction using s-shaped edges may be adapted to form a cover of preferred characteristics using various other shapes. For instance, a generally cubical configuration using s-shaped edges will also form elongated marginal areas of increased rigidity imparted by a pronounced gathering of stitching, roughly 1½ times longer than conventional construction.

Additionally, such construction will yield a regular pattern of folding and waving as desired for increased traction and grip when kicked. Also, such construction using s-shaped edges may be utilized to produce a footbag of increased rebound characteristics, imparted by longer, more tightly gathered and therefore, more ridged, s-shaped marginal areas folding along outer-curve sections and waving along minor-width sections. Additionally, the use of a spherical shape retainer may also be utilized to produce a footbag of increased rebound propensity and improved spherical dimensions.

With attention to FIG. 2, a regularly apertured, spherical shaped retainer 2 having a slightly smaller size than the cover 1 when fully expanded is positioned immediately inside said cover. A suitable retainer may be adapted from a pliable molded plastic or rubber inflated toy ball, by cutting ½ inch holes 14 such that air may pass freely and evenly in or out of the retainer 2. A shaper retainer thus or otherwise fashioned, may be easily collapsed be applying an external force and should quickly reassume its original shape when such force is withdrawn.

Assembly is accomplished by collapsing the retainer 2 such that it may be inserted through the unfinished portion of the cover 1. Once inserted, a balloon may be inserted into one of the retainer's multiple apertures 14 and filled with water until the retainer 2 and cover 1 have fully expanded and are conformed to each other. The water may then be released and the balloon removed. Presently, the retainer 2 and the cover 1 define a spherical volume accessible via at least one aperture 4 of the retainer and the unfinished portion of the cover.

Bladders

With attention to FIG. 2, the interior of the preferred embodiment is generally filled with a plurality of generally spherical, like-sized, flexible pneumatic bladders 3 each containing a like quantity of pellets 15. The bladders 3 of the preferred embodiment are roughly 1 inch in diameter, filled to near capacity with air and contain 10 potpourri pellets each.

Figure 7:
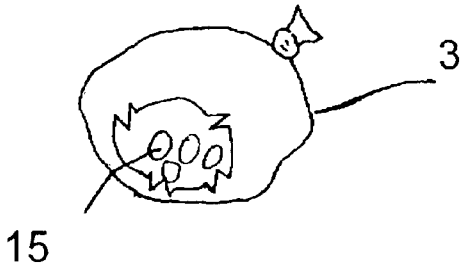
FIG. 7 shows a perspective view of a flexible bladder from the game ball shown in FIG. 2, with a cut-out showing the pellets within the flexible bladder.

FIG. 7 shows one such bladder.

Potpourri pellets are used because they are lightweight and do not have sharp edges, which could rupture the bladders 3. Such bladders may be fashioned by inserting the desired number of potpourri pellets into the open end of a balloon, filling the closed end containing the pellets with the desired volume of air, tying the open end such that the air and pellets are contained within, and finally cutting the excess unused portion of the open end off.

Such bladders 3 constructed as described or otherwise, should be roughly twice as large as the apertures 14 and may be forced into the spherical volume of the retainer 2 using a suitable funnel and lubricant. Once inside, the bladders are effectively contained within the spherical volume of the retainer. When the volume of the retainer 2 is filled as desired with bladders 3, the remaining portion of the cover is completed.

The construction is described for the preferred embodiment may be altered in numerous ways while still remaining within the scope of this invention. For example, larger or smaller balloons of various air retaining materials, filled to a greater or lesser capacity with air and containing more or fewer pellets of various materials and shapes, may fill more or less of the volume of the retainer. Such variations are useful because they allow the weight and rebound propensity to be changed. This accommodates various player preferences, skill levels, and energy requirements. The Socci ball may be slightly larger or smaller for the same reason.

Additionally, multiple bladders containing air and pellets may also be included in other game ball cover embodiments, which may or may not include texturing.

Socci Goals and Field of Play

Figure 8:
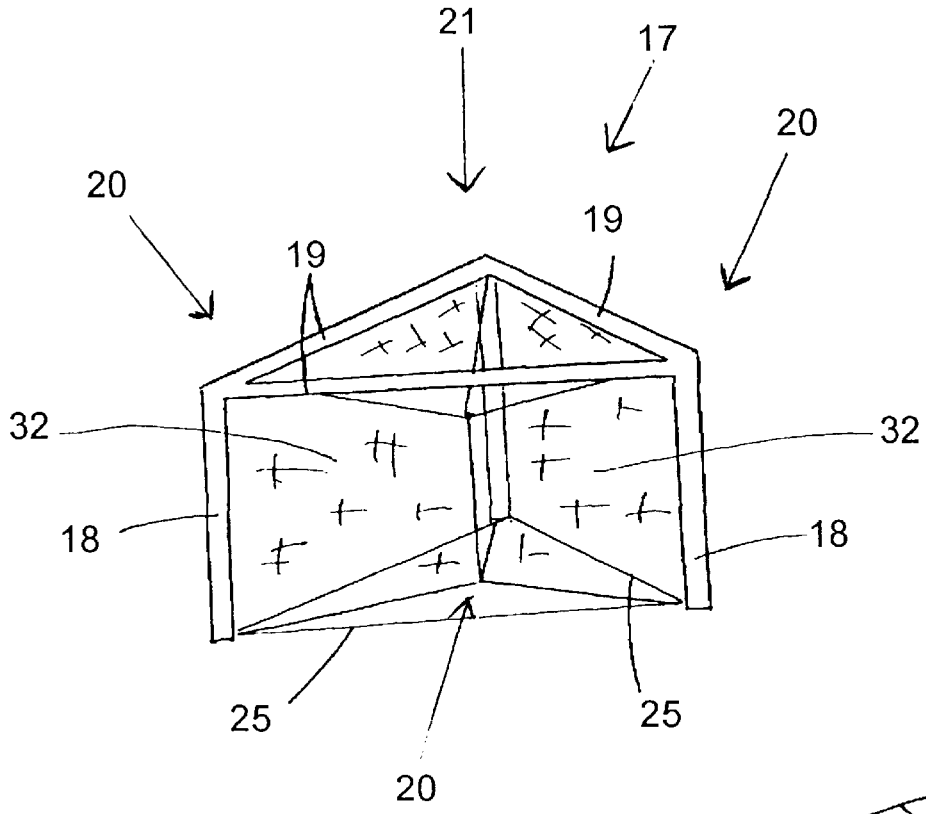
FIG. 8 shows a perspective view of a game goal according to the present invention.

With attention to FIG. 8, the present invention also includes a game goal which may be scored upon via three vertical rectangular side goal planes or one horizontal top goal plan. The goal planes are formed by netting within the goal. A Socci goal 17 can be generally prism-shaped, open-faced structures which are internally segregated by netting or the like. The open-faces of the goal are preferably defined by 3 foot vertical goal bars 18, 4 foot horizontal goal bars 19, and goal lines 25 and goal bars 18, 19 and goal lines 25. They generally comprise three rectangular 3 feet by 4 feet vertical side goal planes 20 and one 4 feet by 4 feet by 4 feet horizontal top facial plane 21. Such dimensions promote defensive play with the lower body as well as offensive power and accuracy. Various materials and means of securing, defining, and segregating such goal planes are possible. The size of the goal may vary.

Figure 9:
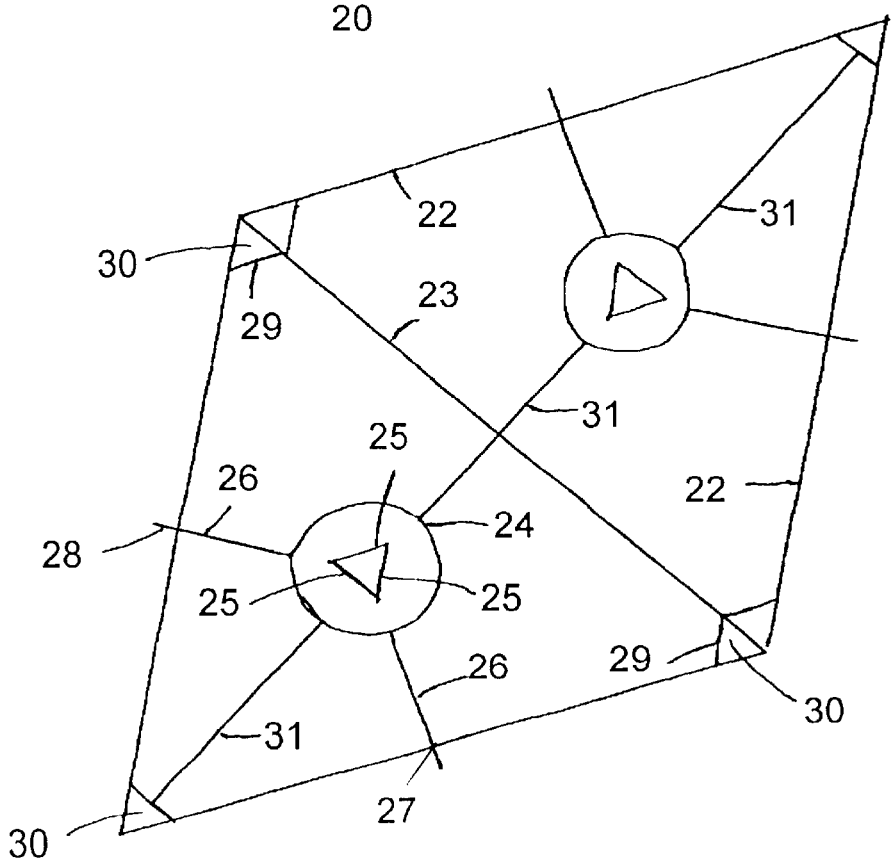
FIG. 9 shows a plan view of a playing field according to the present invention, showing goal positions.

Regarding FIG. 9, the field of play for Socci is in the shape of a parallelogram. Four boundary lines 22 and a half-court line 23 of the Socci field of play are defined by two equilateral triangles, preferably having 86 foot sides adjoined along a common edge. Each triangular side of the field concentrically contains a defensive circle 24 with a radius of 9 feet and 4 foot triangular goal lines 25. The points of the triangular goal lines 25 correspond perpendicularly to the midpoints 26 of boundary lines 22 and half-court line 23.

Perpendicular lines 27, which are perpendicular to the boundary lines, extend from the defensive circle 24 to the midpoints 26 of the boundary lines 22 and a minor distance 28 beyond. The field of play also includes edge lines 29 which define triangular areas 30 at the points of the field and diagonal line 31 which extends from one end of the field to the other, preferably excluding the triangular areas 30 and the areas within the defensive circle 24.

Figure 10:
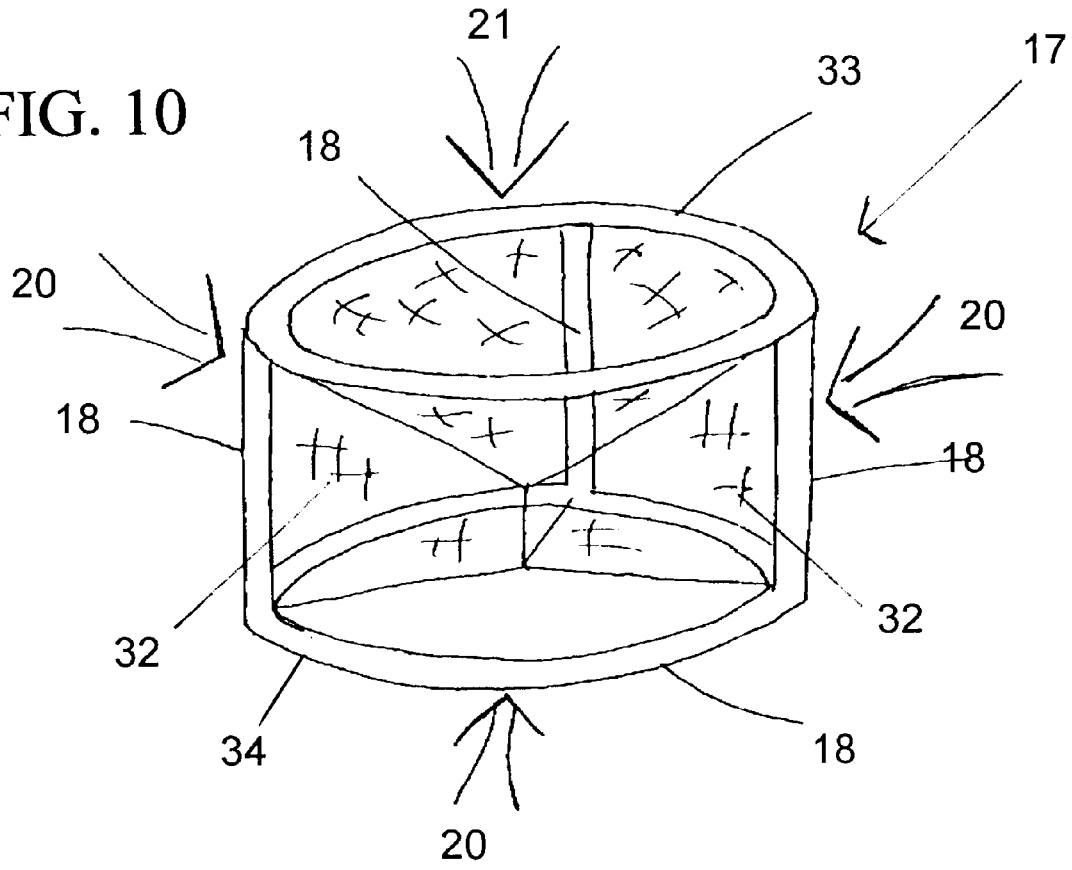
FIG. 10 shows a plan view of a game goal according to FIG. 9.
Figure 11:
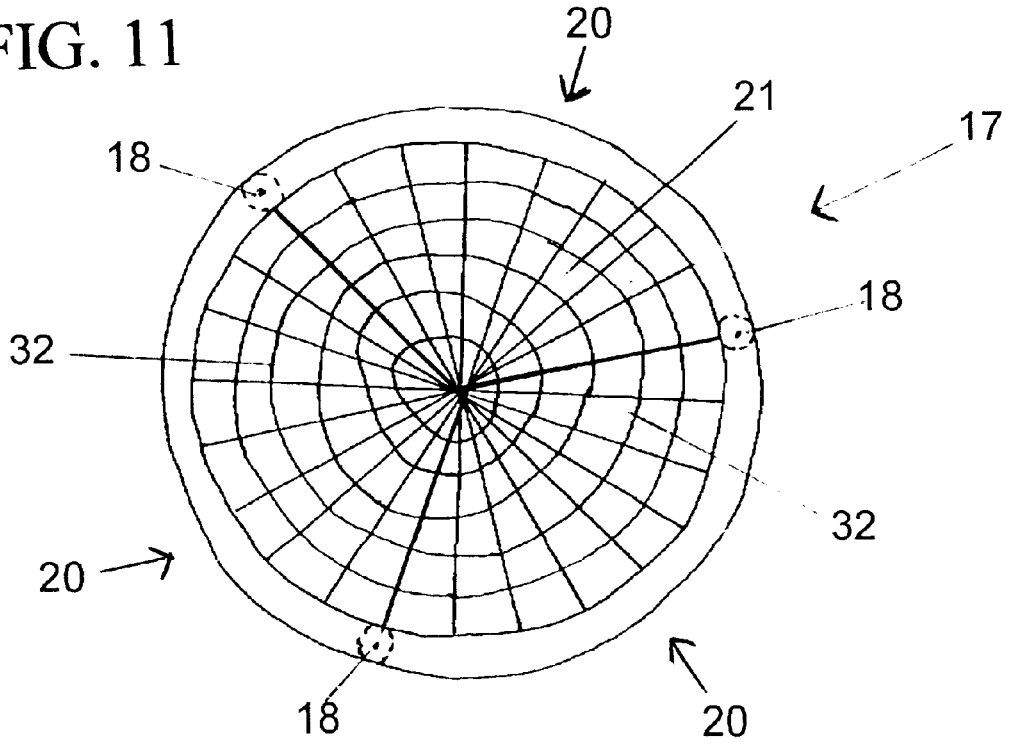
FIG. 11 shows another view of the game goal according to FIG. 9.

FIGS. 10 and 11 illustrate an alternate embodiment of a game goal 17. This goal comprises a frame in the general shape of a flat cylinder with a vertical axis and a diameter greater than its depth, as shown in FIG. 10. The frame, which is preferably made of PVC (polyvinyl chloride) pipe or the like, comprises two like, horizontal circles, one on top 33 and one on the bottom 34 of the goal. The bottom frame circle 34 rests on the playing field. Three or more rigid vertical members 18 extend upward and connect the bottom frame circle 34 to the top frame circle 33. The goal comprises netting which is suspended inside from the top of the frame in a generally conical shape. Netting is also stretched from one vertical member 18 to another across the inside diameter of the cylinder-shaped goal to form three vertical side goal planes 20. To score, the game ball must be thrown or kicked into one of the three vertical side planes or into the top facial plane 21 of the goal.

Basic Method of Play

Ball control

1. The ball may be controlled, shot, received, or passed from the air or from the balls first bounce using any part of the body except the arms or hands.

2. After the ball's first bounce, when played as in 1, it becomes a ground ball playable until it stops by any player except the last player to contact it except when such last contact is a legal change of possession taken from the air or first bounce.

3. A ground ball, or a ball which is not airborne or engaged in it's first bounce, must be played by a single contact such that it becomes airborne and is played again before it becomes a ground ball again and possession is lost.

Ball possession

1. The last team to legally contact the ball is the possessing team.

2. Possession changes when the ball is illegally played, goes out of bounds, scores, or stops movement on the playing field.

3. The possessing team has right of way to any position on the field which is not already occupied by a member of the opposite team, except inside the defensive circle.

Defensive play

1. The opposing team may steal or intercept the ball when no contact occurs during any part of the attack from when the attacking side of that player engages in the attempt to when the attacking side of that player returns to the ground. Except inside that teams own defensive circle.

2. The opposing team may not move into the immediate playing space of a player controlling, passing, shooting or receiving such that the ball cannot be normally played without resulting in contact. Except inside that teams defensive circle.

3. The opposing team may not move in front of an offensive player such as to block that player from controlling, passing, shooting, or receiving the ball when there is a reasonable chance that the ball can be reached. Except inside that teams defensive circle.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A substantially spherical, impact deformable, shape retaining, textured game ball, comprising:

a) pliable leather or leather-like textured ball cover, the cover comprising identical, connected cover members having a discreet symmetrical S- shape;

b) a collapsible, regularly apertured shape retainer enclosed by and adjacent to the cover, and c) an inner space comprising a plurality of like-sized flexible bladders within the game ball, each bladder comprising a volume of air and a quantity of pellets.

* * * * *